United States Patent [19]

Nordman

[11] Patent Number: 4,828,263

[45] Date of Patent: May 9, 1989

[54] FLIPPER WITH AIMING MARKINGS

[75] Inventor: Dennis Nordman, Des Plaines, Ill.

[73] Assignee: Bally Midway Mfg. Co., Chicago, Ill.

[21] Appl. No.: 152,738

[22] Filed: Feb. 5, 1988

[51] Int. Cl.[4] ..... A63F 7/10

[52] U.S. Cl. ..... 273/119 A; 273/119 R; 273/129 R

[58] Field of Search ..... 273/119 A, 119 R, 118 R, 273/118 A, 118 D, 120 R, 120 A, 121 R, 121 A, 123 R, 123 A, 124 R, 124 A, 125 R, 125 A, 129 R, 129 V

[56] References Cited

U.S. PATENT DOCUMENTS

| | | | |
|---|---|---|---|
| 1,409,966 | 3/1922 | Plant | 273/175 |
| 3,727,740 | 4/1973 | Evans et al. | 273/129 V |
| 4,109,916 | 8/1978 | Breslow et al. | 273/121 A |
| 4,199,143 | 4/1980 | Dieckhaus | 273/121 A |

FOREIGN PATENT DOCUMENTS

| | | | |
|---|---|---|---|
| 802290 | 9/1936 | France | 273/119 R |

*Primary Examiner*—Robert E. Garrett
*Assistant Examiner*—John T. Kwon
*Attorney, Agent, or Firm*—Niro, Scavone et al.

[57] ABSTRACT

A flipper for use in pinball-type games has a plurality of grooves disposed on its top surface to permit the player to predetermine and control the path of the ball. When the ball is aligned with one of the grooves and the flipper is activated, the ball is propelled along the path indicated by the groove. The flipper is at least 3⅛ inches in length and its impact surface is 1-1/16 inches high. The impact surface is substantially perpendicular to the playfield.

7 Claims, 2 Drawing Sheets

FLIPPER WITH AIMING MARKINGS

FIELD OF THE INVENTION

The invention relates to the field of ball rolling or pinball-type games and more particularly to player activated flippers for use in such games.

BACKGROUND OF THE INVENTION

The object of most ball rolling, pinball-type games is to score as many points as possible while keeping at least one ball in play as long as possible. The playing field of such a game is usually composed of various targets, each target having a certain point value. Hitting the targets accrues certain points to the player. Often, these targets have point values that increase each time they are hit. Therefore, it is to the players' benefit to hit the targets repeatedly. Since the balls in these games typically roll down a downwardly sloping playing field, player actuated flippers, usually two or more, are located on the playing field and are used to propel the balls upwards toward the score-bearing targets. The flippers typically are capable of two positions: a first, unactivated position and a second, activated position in which the flipper is rotated at one end through a limited angle.

In many of these games, the ball may be caught temporarily in the chevron formed by a flipper in its second, activated position and the wall of the playing field adjacent the flipper mechanism.

This catching of the ball slows down the game and gives the player control over the ball rather than simply attempting to propel the ball upward with the flipper. When the flipper is deactivated, the ball travels downward along the length of the flipper until the flipper is activated a second time. When the flipper is activated a second time, the ball is propelled upwards. The ball is propelled upwards in different directions depending on how far downward along the length of the flipper the ball has rolled before the flipper has been activated the second time. For example, the ball will be more likely to be propelled towards the opposite side of the playing field from the flipper when the ball is near the end of the flipper opposite the end where it was initially caught.

Therefore, a ball may travel along at least a portion of the flipper in two instances. The first instance is when a ball is caught and then the flipper is deactivated, as described above. The second instance is simply when the ball rolls down the playing field and impacts the flipper. In the second instance, the player has the option of activating the flipper when the ball first impacts the flipper or after the ball has rolled downward along a portion of the length of the flipper. In both instances, it would be desirable for a player to be able to ascertain and exercise some control over the direction in which the ball would be propelled upwards after activation of the flipper. It would be desirable for a player to be able to aim the ball towards targets of his or her choice. However, with known flipper designs, only the most skilled players can judge at what point the flipper should be activated to propel the ball generally towards certain targets.

SUMMARY OF THE INVENTION

It is therefore an object of the invention to provide a pinball flipper with aiming indicia to aid the player in aiming the ball.

It is a further object of the invention to provide a pinball flipper with aiming indicia, preferably a plurality of grooves, on the top portion of the flipper. When the ball is aligned with one of these markings, and the flipper is activated at the time of this alignment, the ball is propelled upwards on the playing field in the direction generally in line with the marking.

It is an additional object of the invention to enable relatively unskilled players to increase their scores by allowing them to better determine which direction a ball will travel when they activate a flipper.

Another object of the invention is to provide a pinball flipper with a substantially perpendicular draft angle in order to improve player control. Player control is also enhanced by lengthening the flipper and increasing its height.

BREIF DESCRIPTION OF THE DRAWINGS

Figure 1:
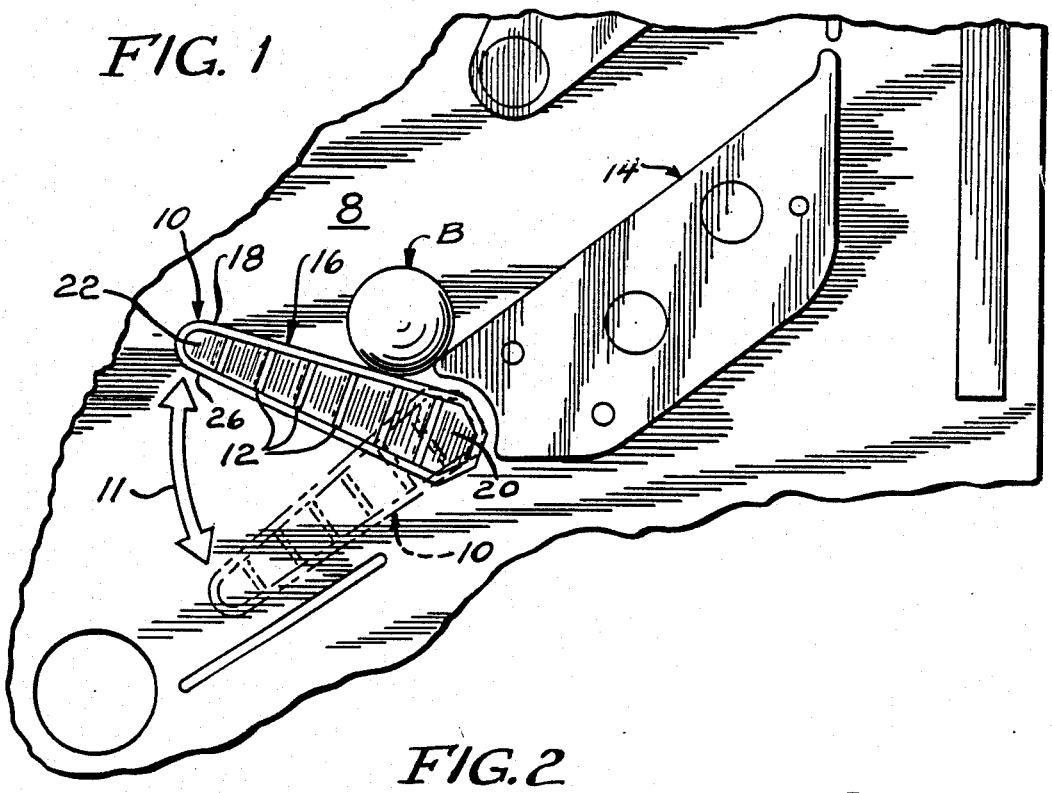
FIG. 1 is a top view of a portion of a playfield of a pinball game illustrating the activation of a flipper.
Figure 3C:
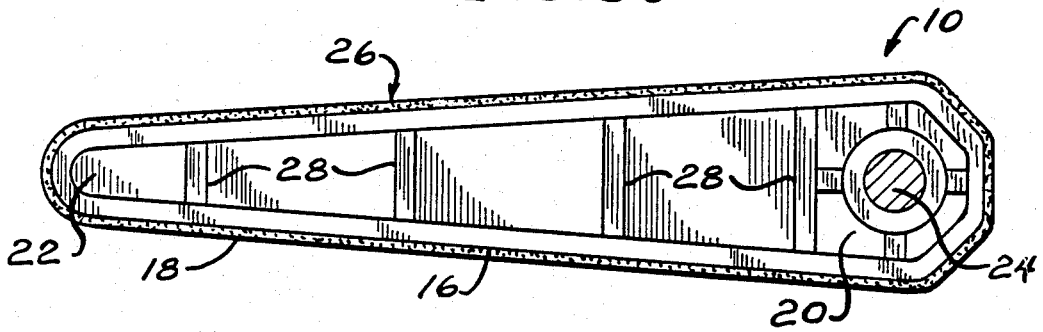
Figure 3A:
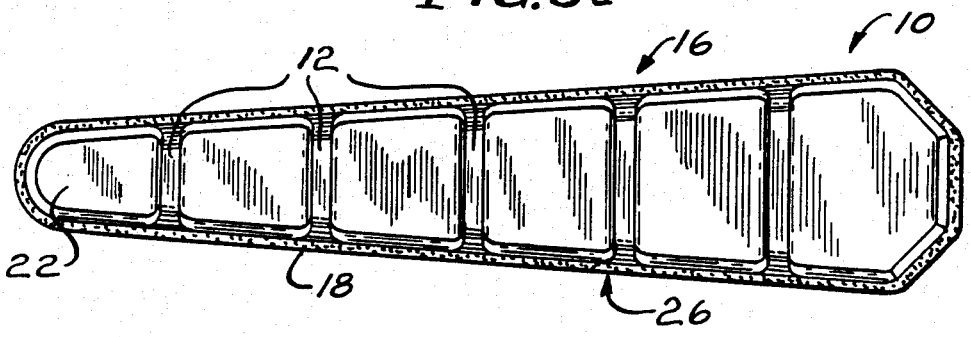
Figure 3B:
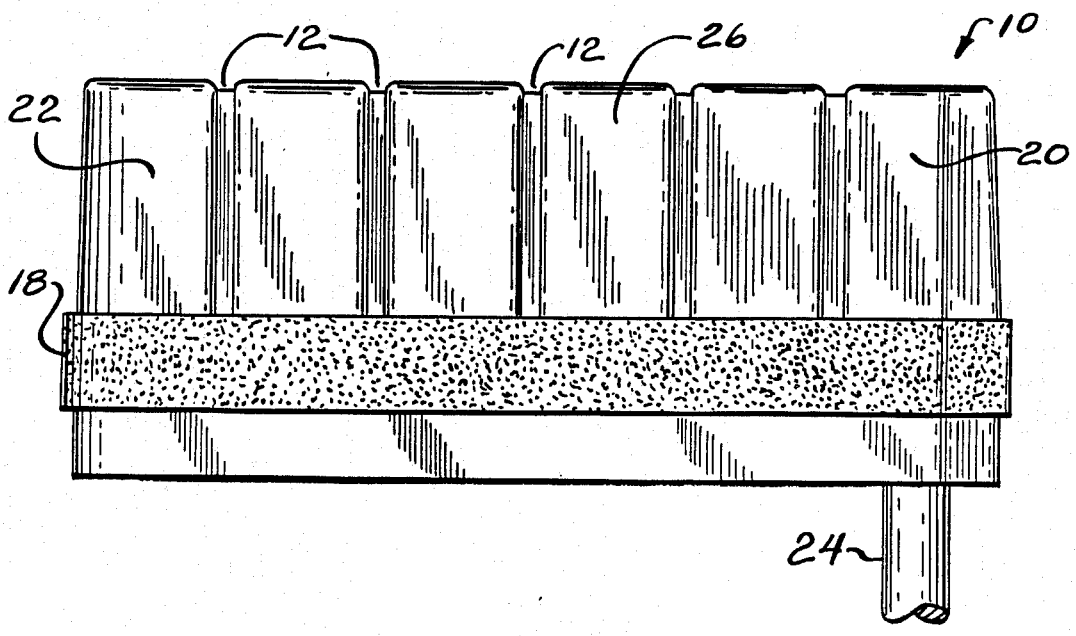

FIG. 3*a* is a top plan view of the flipper shown in FIG. 1;

FIG. 3*b* is a side plan view of the flipper of FIG. 3*a*; and

FIG. 3*c* is a bottom plan view of the flipper of FIG. 3*a*.

DETAILED DESCRIPTION OF THE DRAWINGS

FIG. 1 is an illustration of a portion of a pinball-type game playfield 8 that includes a player activated flipper 10. As is well known in the art, the flipper 10 can be caused by a player to rotate angularly, indicated by an arrow 11, from a first position illustrated in dashed lines to a second or activated position illustrated in solid lines. In FIG. 1, a ball B is shown as temporarily caught in a chevron formed by the flipper 10 in its second activated position and a wall 14 of the playing field adjacent the flipper 10. Normally, the ball B is caught when it travels downward along the playfield 8 such that the player is able to anticipate that if he or she activates the flipper 10, the ball B will be so caught.

Figure 2:
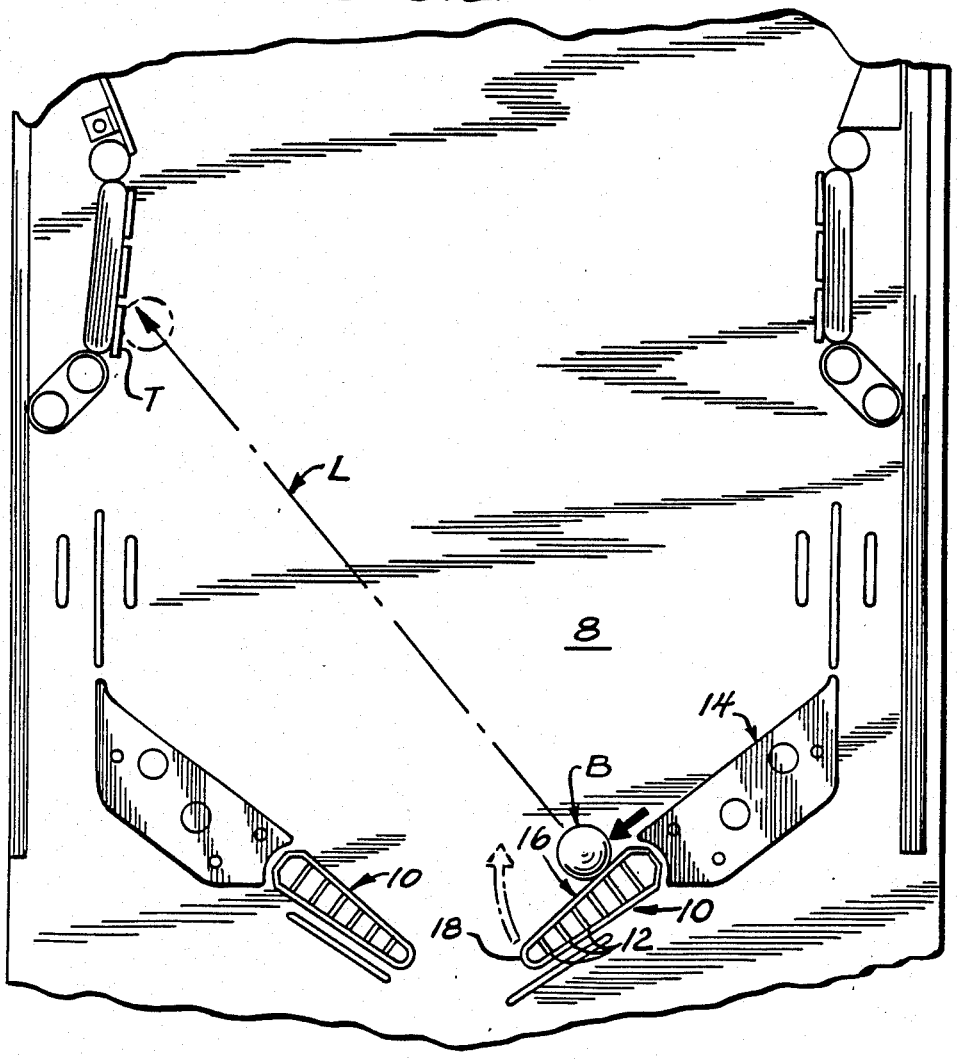
FIG. 2 is an expanded top view of the portion of the playfield of FIG. 1 illustrating the direction of travel of a ball after activation of the flipper.

An expanded view of the playfield 8 in FIG. 2 shows the situation when the ball B is travelling downward along a side 16 of the flipper 10. This can occur when the flipper 0 is deactivated after catching the ball B, as described above, or at different times during a game when the ball is rolling down the side 16 of the flipper 10. The flipper 10 is configured with a number of laterally spaced grooves or aiming indicia 12. As depicted in FIG. 2, the center of ball B is shown aligned with one of the grooves 12. If the flipper 10 is activated when the ball B is so aligned, the ball B is propelled in a predetermined direction up the playfield 8; depicted by a dotted line L towards a target T.

FIGS. 3*a-c* depict top, side and bottom views respectively of the preferred embodiment of flipper 10. In FIG. 3*a*, the flipper 10 is shown configured with the grooves 12. The length of flipper 10 in this embodiment is approximately 3⅛ inches which is longer than prior flipper designs. Flipper 10 also includes a resilient ball impact material, preferably a rubber band 18 which encircles flipper 10 and covers at least a portion of the horizontal walls of flipper 10. Flipper 10 has two ends:

a first, larger radius end 20 and a second, smaller radius end 22.

As shown, the draft angle of side 16 of flipper 10 is substantially perpendicular. The draft angle is defined as the angle which the side 16 of flipper 10 makes with the playfield 8. Prior flipper designs normally incorporate obtuse draft angles, but it has been discovered that there is an advantage to having a substantially perpendicular draft angle. A substantially perpendicular draft angle affords, for example, greater control over the travel of the ball B after it is propelled upwards by flipper 10. Specifically, if the flipper has a substantially perpendicular draft angle, the ball is less likely to bounce along the playing field after it is hit thus increasing player control.

In FIG. 3*b*, a side view of flipper 10 is provided. Although various types of markings would fulfill the same function, grooves 12 are the preferred aiming indicia for permitting the player to predetermine the direction of ball travel. Grooves 12 are shown to extend partially down the sides of flipper 10. The grooves, as depicted, are about 1/16th of an inch wide, and about 1/32nd of an inch deep. The rubber impact material 18 is positioned slightly above the bottom of flipper 10. A shaft 24 is secured to flipper 10 at the first end 20. The shaft 24 is rigidly attached to a flipper mechanism, such as a solenoid or motor (not shown), effective to rotate flipper 10 when the flipper mechanism is activated by a player.

The height of ball impact surface 16 and of the opposite surface 26 is greater than prior flipper designs. The height depicted is about 1-1/16 inches. This extra height also provides the player with greater control over the ball B since the probability of the ball B jumping over flipper 10 on impact is substantially reduced.

The additional height, substantially perpendicular draft angle and longer length of flipper 10 results in a design that provides a player with greater control over the ball over prior flipper designs.

In FIG. 3*c*, the bottom view of flipper 10 is shown. A plurality of laterally spaced support partitions 28 are integrally connected to the rest of flipper 10. The flipper 10 is also preferably made of a molded plastic construction. The shaft 24 is depicted at the first end 20 of flipper 10.

In summary, the aiming indicia illustrated in FIGS. 1-3*b* aids the player in predetermining the direction of travel of the ball B upon activation of flipper 10. When the ball B is aligned with one of the aiming indicia and flipper 10 is activated, the ball B is propelled upwards in the direction generally indicated by the aiming indicia with which the ball is so aligned. In addition, the increased length and height of the flipper 10 along with the substantially vertical draft angle provides greater player control of the ball.

I claim:

1. A flipper for use in ball rolling games having a substantially planar playfield, comprising:

(a) an elongated rotatable member including a substantially linear ball impact surface; and (b) aiming indicia disposed on the top portion of said rotatable member and substantially transversely disposed to said impact surface to aid a player in determining and controlling the path of ball travel upon actuation of said flipper.

2. The flipper of claim 1 wherein said aiming indicia include a plurality of laterally spaced grooves on the top portion of said rotatable member.

3. The flipper of claim 1 wherein said ball impact surface is substantially perpendicular to the playfield.

4. The flipper of claim 1, wherein said rotatable member is at least 3⅛ inches in length.

5. An improved flipper for use in ball rolling games having a player activated rotatable member including a substantially linear ball impact surface, wherein the improvement comprises:

means disposed on said member for improving the player's ability to predetermine and control the path of the ball upon actuation of said flipper, said means being substantially transversely disposed to the ball impact surface.

6. A flipper for use in a ball rolling game having a substantially planar playfield, comprising:

a rotatable member with a linear ball impact surface substantially perpendicular to the playfield; and at least five laterally spaced grooves disposed on the top of said member wherein said grooves are substantially transversely disposed to said impact surface for more accurately determining the path of the ball.

7. The flipper of claim 6, wherein said rotatable member is at least 3⅛ inches in length.

* * * * *